United States Patent [19]

Inoue et al.

[11] Patent Number: 4,947,812

[45] Date of Patent: Aug. 14, 1990

[54] POSITIVE CRANKCASE VENTILATION SYSTEM

[75] Inventors: Yasushi Inoue; Shigeki Nakatani, both of Hiroshima, Japan

[73] Assignee: Mazda Motor Corporation, Hiroshima, Japan

[21] Appl. No.: 406,341

[22] Filed: Sep. 13, 1989

[30] Foreign Application Priority Data

Sep. 13, 1988 [JP] Japan ..... 63-230737

[51] Int. Cl.[5] ..... F02M 25/00

[52] U.S. Cl. ..... 123/193 C; 123/572; 123/196 M; 123/195 H

[58] Field of Search ..... 123/572, 193 C, 193 CH, 123/195 H, 196 M, 573, 196 CP

[56] References Cited

U.S. PATENT DOCUMENTS

| | | | |
|---|---|---|---|
| 4,493,295 | 1/1985 | Ampferer | 123/196 CP |
| 4,603,673 | 8/1986 | Hiraoka et al. | 123/572 |
| 4,656,991 | 4/1987 | Fukuo et al. | 123/572 |
| 4,712,532 | 12/1987 | Ura et al. | 123/572 |
| 4,838,221 | 6/1989 | Suemori | 123/192 B |

FOREIGN PATENT DOCUMENTS 62-170715 6/1987 Japan .

*Primary Examiner*—Andrew M. Dolinar
*Assistant Examiner*—M. Macy
*Attorney, Agent, or Firm*—Fleit, Jacobson, Cohn, Price, Holman & Stern

[57] ABSTRACT

A positive crankcase ventilation system for a V-type internal combustion engine has elongated first and second cylinder banks provided with first and second rows of cylinders offset, respectively, in a lengthwise direction to each other, thereby forming a dead corner on one end of each cylinder bank. A series of reinforcing bulk heads for reinforcing a series of main bearings holding a crankshaft divide a crankcase into a series of crankcase chambers. Each crankcase chamber is provided with a bottom opening and vent holes formed in the bulk head. An air introduction passage is provided by the side of and at the middle of each row of cylinders in the cylinder block for introducing filtered air into and through the crankcase and oil return passages are formed in each dead corner.

13 Claims, 4 Drawing Sheets

POSITIVE CRANKCASE VENTILATION SYSTEM

FIELD OF THE INVENTION

The present invention relates to a positive crankcase ventilation system for a V-type internal combustion engine.

BACKGROUND OF THE INVENTION

In a positive crankcase ventilation system of an internal combustion engine for circulating crankcase vapors into an intake system to prevent them from being discharged directly into the atmosphere, a blow-by gas passage, communicating a crankcase and a rocker arm chamber of the internal combustion engine with each other, and an oil return passage, are generally formed as one and the same. In a V-type internal combustion engine, which has left and right cylinder banks arranged offset in a lengthwise direction in which a crankshaft of the V-type internal combustion engine extends, it is preferable to use part of each cylinder bank left as a dead part or corner on one end of a row of cylinders formed in the same cylinder bank to form a blow-by gas passage in the dead corner independently of an oil return passage. This not only brings about an improved efficiency in returning oil, but decreases contamination of oil into blow-by gases. Such a formation of oil return and blow-by gas passages is known from Japanese Unexamined Patent Publication No. 62 170,715 entitled "V-Type Engine", published July 27, 1987.

It is a well known fact that, because main bearings of a V-type internal combustion engine are loaded diagonally downward from the right and left, with tremendously heavy loads produced as a result of fuel explosions and inertial forces of pistons of the internal combustion engine through a crankshaft, the V-type internal combustion engine must have an inadequate dynamic stiffness of a lower structure of a cylinder block, such including main bearings and main bearings caps.

To give such a sufficient stiffness, it is known to provide reinforcing bulk heads integrally formed with and extending downward from the main bearing caps of the main bearings rotatably holding the crankshaft of the V-type internal combustion engine and to connect them integrally with one another. In such a lower cylinder block structure, however, a crankcase is unavoidably partitioned into several small crankcase chambers, resulting in insufficient crankcase ventilation. Even though the blow-by gas passage can be formed on one end of each row of cylinders in the dead corner of each cylinder bank of a V-type internal combustion engine, the small crankcase chambers partitioned by the reinforcing bulk heads worsens the flow of blow-by gases and, therefore, are still hard to sufficiently ventilate. This leads to a gradual deterioration of oil quality, due to contact of the oil with blow-by gases staying in the crankcase. When an air introduction passage for positive crankcase ventilation is provided or formed on one end of the row of cylinders in the dead corner of each cylinder bank, the air introduction passage is apt to be filled with, oil in the crankcase due to the oil getting rough or agitated when a vehicle, starts or turns, so as to cause ineffficient operation of the positive crankcase ventilation system of the V-type internal combustion engine.

SUMMARY OF THE INVENTION

The primary object of the present invention is to provide a novel positive crankcase ventilation system for a V-type internal combustion engine in which contact of blow-by gases with oil is minimized and oil returns to a sump or oil pan with a high efficiency.

Another object of the present invention is to provide a novel positive crankcase ventilation system for a V-type internal combustion engine which provides both a high stiffness of a lower part structure, including main bearing caps, of a cylinder block of the V-type internal combustion engine and a sufficiently ventilated crankcase for the cylinder block of the V-type internal combustion engine.

The objects of the present invention are achieved by a positive crankcase ventilation system for a V-type internal combustion engine having a cylinder block which is provided with elongated first and second cylinder banks set at an angle to each other and a crankcase formed in a bottom thereof. The first and second cylinder banks are, respectively, provided with first and second rows of cylinders offset in a lengthwise direction in which a crankshaft of the internal combustion engine extends relative to each other, thereby forming a dead part or corner on one end of the row of cylinders in each cylinder bank. A series of reinforcing bulk heads, respectively, to reinforce a series of the main bearings holding a crankshaft of the internal combustion engine are provided. The bulk heads divide the crankcase into a series of crankcase chambers. Each crankcase chamber is provided with an opening formed in a bottom wall and at least one vent hole formed in the bulk head. An air introduction passage is provided by the side of, and at the middle of, the row of cylinders in each cylinder bank for introducing filtered clean air into the crankcase. At least one oil return passage and a blow-by gas passage are formed on one end of the row of cylinders in each dead corner left in the cylinder block through which oil returns into an oil pan attached to the bottom of the cylinder bank and the air mixed with blow-by gases is drawn or discharged out of the crankcase, respectively.

BRIEF DESCRIPTION OF THE DRAWINGS

Still other objects of the invention and more specific features will become apparent to those skilled in the art from the following description of the preferred embodiment considered together with the accompanying drawings wherein like reference characters have been used in the different figures to denote the same parts.

DESCRIPTION OF THE PREFERRED EMBODIMENT

Figure 1:
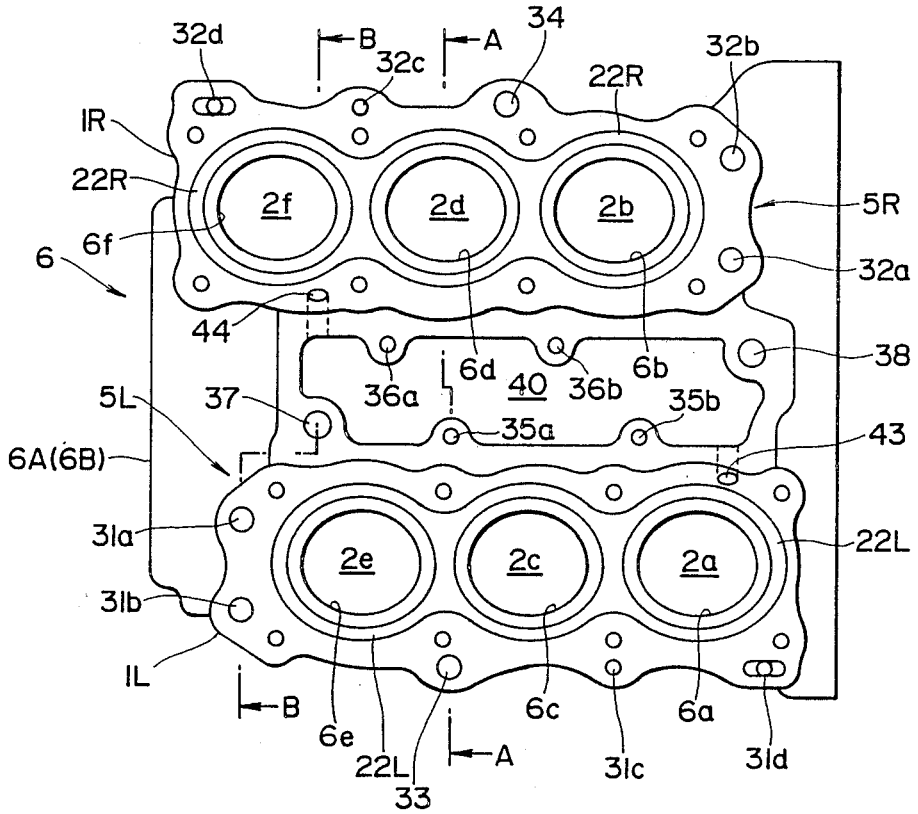
FIG. 1 is a plan view showing a cylinder block of a V-6 internal combustion engine having a positive crankcase ventilation system in accordance with a preferred embodiment of the present invention.
Figure 2:
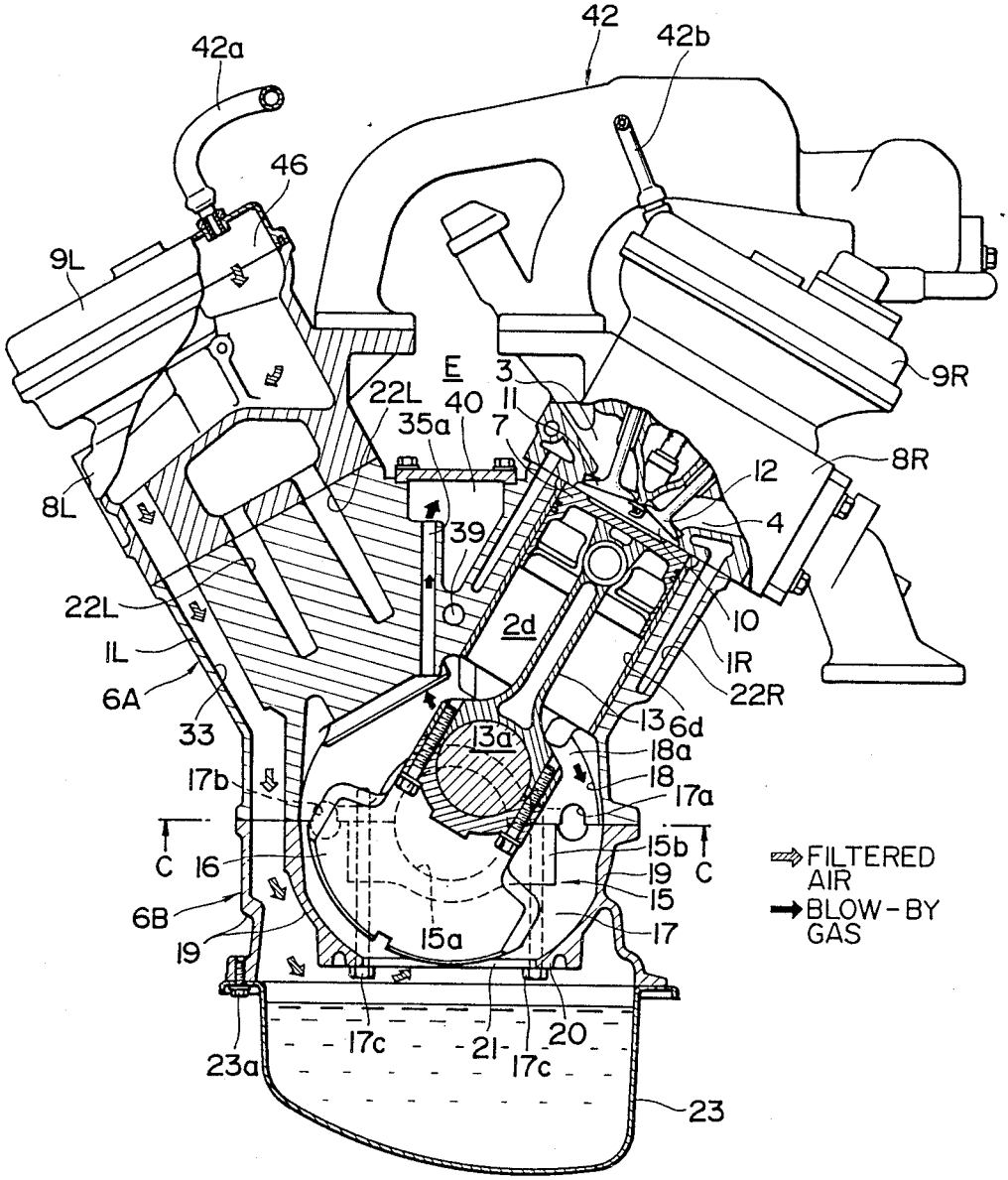
FIG. 2 is an elevational view of a V-6 internal combustion engine having a positive crankcase ventilation system in accordance with a preferred embodiment of the present invention, partly in section taken along line A—A in FIG. 1.
Figure 3:
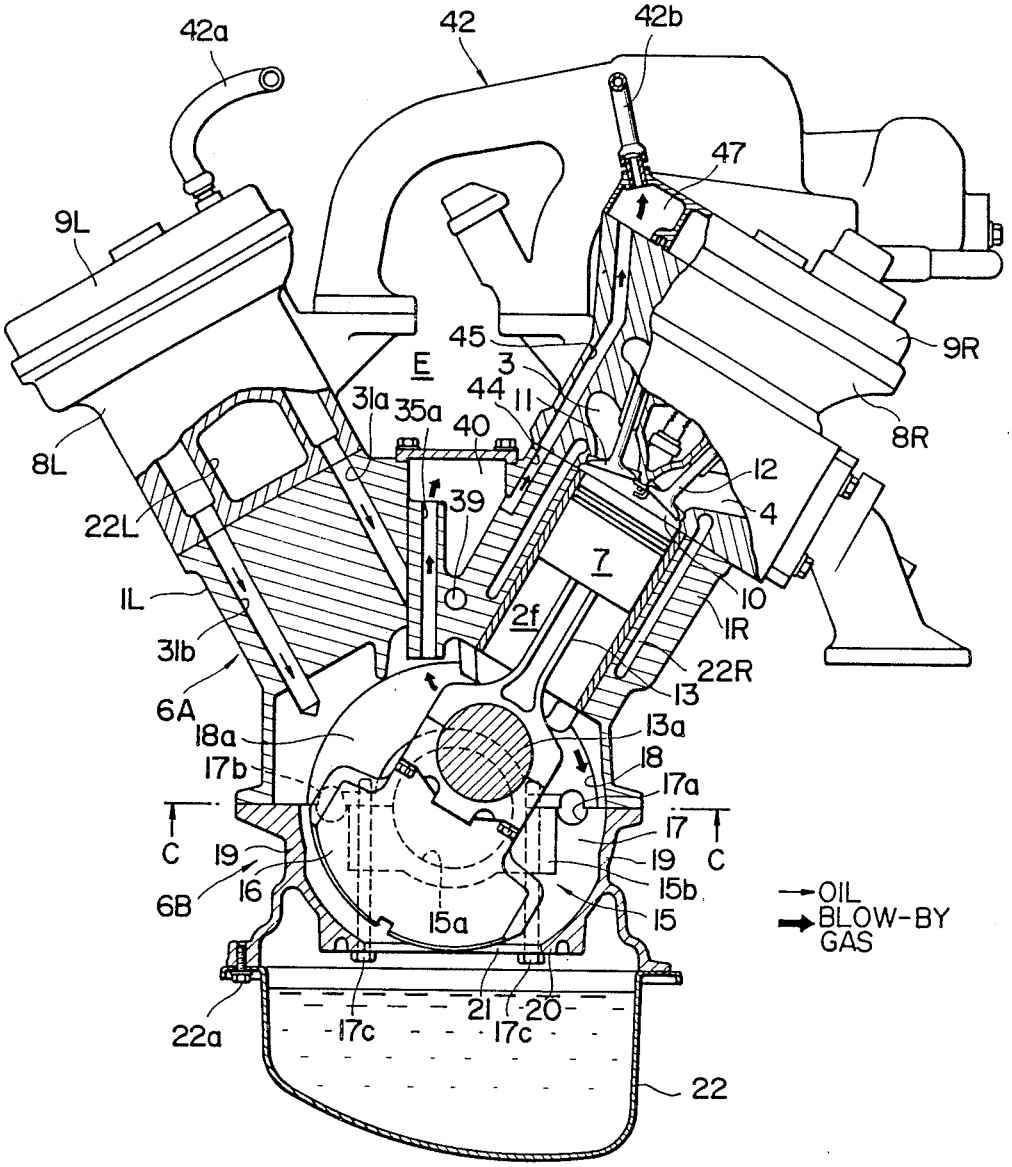
FIG. 3 is an elevational view, similar to that of FIG. 2, partly in section taken along line B—B in FIG. 1.
Figure 4:
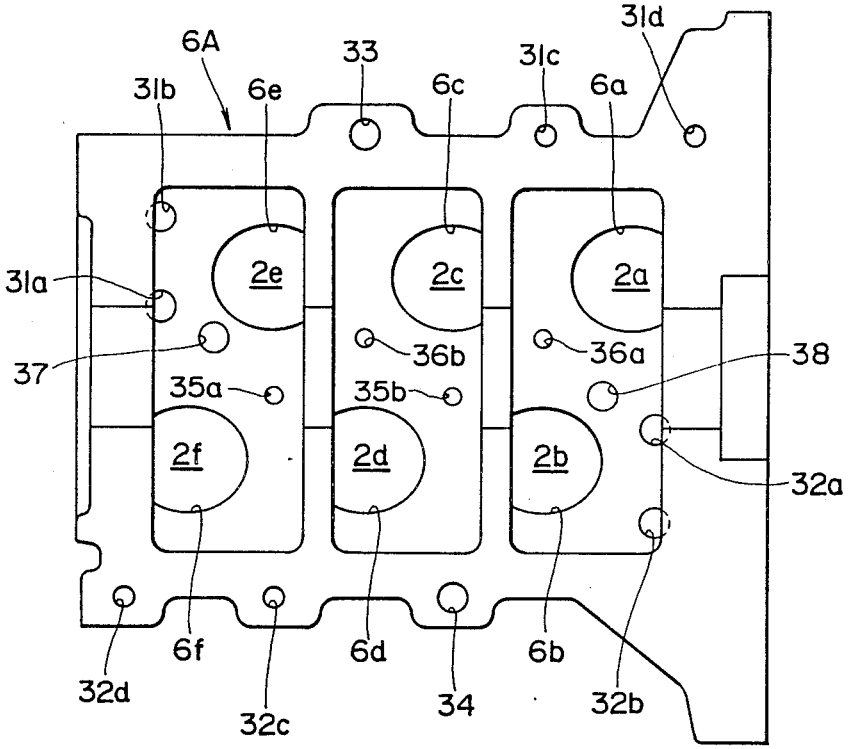
FIG. 4 is a bottom view of FIG. 1 taken along line C13 C.

Referring to FIGS. 1 to 4 in detail, an engine body E of a V-6 internal combustion engine having a positive crankcase ventilation system in accordance with a preferred embodiment of the invention is shown, consisting of first or left and second or right cylinder banks 1L and 1R arranged in a V-formation at a predetermined relative angle, for example, a relative angle of approximately 60 degrees. The No. 1, No. 3 and No. 5 cylinders 2*a*, 2*c* and 2*e* are formed in the left cylinder bank 1L in order from the right, as viewed in FIG. 1, referred to as the front side, and the No. 2, No. 4 and No. 6 cylinders 2*b*, 2*d* and 2*f* are formed in the right cylinder bank 1R in order from the front side. The No. 1 cylinder 2*a*, the No. 6 cylinder 2*f*, the No. 3 cylinder 2*c*, the No. 4 cylinder 2*d*, the No. 5 cylinder 2*e* and the No. 2 cylinder 2*b* are fired in this order. That is, the cylinders 2*a* to 2*f* are divided into two groups and the cylinders in each group are disposed in one and the same cylinder bank 1L or 1R, respectively, so that adjoining cylinders in each cylinder bank 1L or 1R do not fire one after another. The cylinders 2*a*, 2*c* and 2*e* in the left cylinder bank 1L and the cylinders 2*b*, 2*d* and 2*f* in the right cylinder bank 1R are arranged in rows parallel to a crankshaft 14, respectively. The rows of the cylinders 2*a*, 2*c* and 2*e*, and the cylinders 2*b*, 2*d* and 2*f* in the left and right cylinder banks 1L and 1R are offset relative to each other in a direction in which a crankshaft of the internal combustion engine E extends. This offset arrangement of the rows of, the cylinders 2*a*–2*f* causes part of each cylinder bank 1L, 1R to be left as a dead corner 5L, 5R on one end of each row of cylinders in each cylinder bank 1L, 1R.

Engine body E of the internal combustion engine has a cylinder block comprising upper and lower cylinder blocks 6A and 6B. The upper cylinder block 6A is provided with cylinder bores 6*a*–6*f* in which pistons 7 can slide. A left cylinder head 8L is mounted on the upper cylinder block 6A and provides a head for the left cylinder bank 1L and a right cylinder head 8R is mounted on the upper cylinder block 6A and provides a head for the right cylinder bank 1R. Cylinder head covers 9L and 9R are provided to cover the upper portions of the left cylinder head 8L and the right cylinder head 8R, respectively. Combustion chambers 10 are formed in the cylinders 2*a*–2*f* by the tops of the pistons 7, a lower wall of the cylinder heads 8R and 8L and the cylinder bores 6*a*–6*f*. Intake ports 3 and exhaust ports 4 open into each combustion chamber 10, and are opened and shut at a predetermined timing by intake valves 11 and exhaust valves 12, respectively.

The pistons 7 are connected to rod bearing journals 13*a* forming part of a crankshaft assembly by means of connecting rods 13. The crankshaft assembly, which comprises a crankshaft, connecting rod throws and the rod bearing journals 13*a* connected to one another does not need to be shown in detail because it is able to be of any known type. The crankshaft assembly is disposed in a crankcase 18 which is formed by and between the upper cylinder block 6A and a lower cylinder block 6B bolted to the upper cylinder block 6A and shaped to have a circular cross-section so as to allow the crankshaft assembly including counterbalances 16 and rod bearing journals 13*a* to rotate in the crankcase 18 when the pistons 7 reciprocate. The crankshaft assembly is rotatably held by means of a series of main bearing assemblies 15. The bearing assemblies 15, each consisting of a main bearing 15*a* and a bearing cap 15*b*, are arranged at front and rear ends of the cylinder block 6 and between each of the adjacent connecting rods 13. Every other main bearing assembly 15 is disposed between and firmly held by partition walls 18*a* integrally formed with the upper cylinder block 6A and extending downward in an upper half of the crankcase 18, and a reinforcing bulk head 17 extending downward in a lower half of the crankcase 18 from the bearing caps 15*b* and secured to the partition walls 18*a* with bolts 17*c*, respectively. The remaining main bearing assemblies 15 are secured to the partition walls 18*a*. Accordingly, the crankcase 18 is divided into three crankcase chambers by every other partition wall 18*a* and the bulk heads 17. Each bulk head 17 is shaped to fit the lower half of the crankcase 18 and connected to both of side walls 19 and a bottom wall 20 forming the lower half of the crankcase 18. The crankcase 18 consisting of the upper and lower halves formed in the upper and lower cylinder blocks 6A and 6B, respectively, is shaped to have a substantially circular cross-section so as to allow the rotational motion of counterbalances 16 of the crankshaft assembly. The crankcase 18 is formed with a generally rectangular shaped opening 21 in the bottom wall 20 thereof between each adjacent bulk head 17. The bulk-heads 17 are, respectively, formed with vent holes 17*a* and 17*b* on both sides of the main bearing 15*a* to communicate the three crankcase chambers of the crankcase 18 with each other.

A sump or oil pan 23 is attached to the bottom of the lower cylinder block 6B with cap screws 23*a*.

The upper cylinder block 6A is formed with two oil return passages 31*a* and 31*b* in the rear dead corner 5L of the left cylinder bank 1L on the rear end of the row of the cylinders 2*a*, 2*c* and 2*e* and two oil return passages 32*a* and 32*b* in the front dead corner 5R of the right cylinder bank 1R on the front end of the row of the cylinders 2*b*, 2*d* and 2*f*. The upper cylinder block 6A is further formed with an air introduction passage 33 by the outside of the row of the cylinders 2*a*, 2*c* and 2*e* in the left cylinder bank 1L between the No. 3 and No. 5 cylinders 2*c* and 2*e*, and an air introduction passage 34 at the outside of the row of the cylinders 2*b*, 2*d* and 2*f* in the right cylinder bank 1R between the No. 2 and No. 4 cylinders 2*b* and 2*d*. The air introduction passages 33 and 34, which serve to provide for the circulation of filtered air therethrough to remove crankcase blow-by gases, extend and penetrate through the side walls 19 of the crankcase 18 in the lower cylinder block 6B and open into the oil pan 23. Each air introduction passage 33, 34 is connected to an air inlet 46 communicated with an air cleaner (not shown) by way of a connecting hose 42*a*.

A lower blow-by gas passage 37 is formed in the upper cylinder block 6A between the left cylinder bank 1L and the right cylinder bank 1R by the side of the No. 5 cylinder 2*e*, and a lower blow-by gas passage 38 is formed in the upper cylinder block 6A between the left cylinder bank 1R and the right cylinder bank 1R by the side of the oil return passage 32*a*.

The upper cylinder block 6A is further formed with two lower blow-by gas passages 35*a* and 35*b* located inside the row of the cylinders 2*a*, 2*c* and 2*e* in the left cylinder bank 1L between the respective adjacent cylinders, i.e., the No. 3 and No. 5 cylinders 2*c* and 2*e*, and the No. 1 and No. 3 cylinders 2*a* and 2*e*, respectively. Two lower blow-by gas passages 36*a* and 36*b* are also located inside the row of the cylinders 2b, 2d and 2f in the right cylinder bank 1R between the respective adjacent cylinders, i.e., the No. 4 and No. 6 cylinders 2d and 2f, and the No. 2 and No. 4 cylinders 2b and 2d, respectively. These lower blow-by gas passage 35a, 35b, 36a and 36b are smaller in diameter than the lower blow-by gas passages 37 and 38.

The lower blow-by gas passages 35a, 35b, 36a, 36b, 37 and 38 are so arranged as to keep away from an oil gallery 39 which is formed in the upper cylinder block 6A between the left and the right cylinder banks 1L and 1R and extends in the lengthwise direction, in which the crankshaft 14 of the V-type internal combustion engine E also extends. In particular, the lower blow-by gas passages 37 and 38 are preferably so arranged as to extend downward under the dead corners 5L and 5R of the left and the right cylinder bank 1L and 1R, respectively, so that they certainly have a large cross-sectional area. All of the lower blow-by gas passages 35a, 35b, 36a, 36b 37 and 38 open into a blow-by gas discharge chamber 40 formed in the upper cylinder block 6A between the left and the right cylinder banks 1L and 1R. The blow-by gas discharge chamber 40 is connected to a blow-by gas outlet 47 by way of upper blow-by gas passages 43 and 44 extending through the upper cylinder block 6A and connecting blow-by gas passages 45 formed in the cylinder heads 8L and 8R, respectively. The blow-by gas outlet 47 is communicated with an intake manifold 42 by a connecting hose 42b.

When the vehicle is in motion, a stream of filtered clean air is taken in from the air cleaner through the air introduction passages 33 and 34 and flows towards the front and rear ends of the oil pan 23 from the middle, sweeping over the surface of oil in the oil pan 23. The air is drawn into the crankcase chambers of the crankcase 18 through, the openings 21 in the bottom wall 20 where it mixes with blow-by gases in the crankcase chambers. The mixture of air and blow-by gases in the crankcase chambers is forced to flow in the crankcase 18 passing through the vent holes 17a and 17b formed in the reinforcing bulk heads 17. Then, the mixture of air and blow-by gases is pulled into the intake manifold 42 through the lower blow-by gas passages 35a, 35b, 36a, 36b, 37 and 38 distributed along the crankcase 18 in the lengthwise direction, the blow-by gas discharge chamber 40, the upper blow-by gas passages 43 and 44 and the connecting hose 42b by intake manifold vacuum.

Because of the reinforcing bulk heads provided integrally with the main bearing caps, the lower cylinder block including main bearings is greatly improved in dynamic stiffness against heavy loadings imposed by the crankshaft as a result of fuel explosion and inertial force of pistons of the internal combustion engine E.

Furthermore, even though the crankcase is divided into three or more crankcase chambers, because the fresh air drawn at the middle crankcase chamber of the crankcase actively flows towards both extreme crankcase chambers and also because the blow-by gas passages are provided at both ends of the crankcase, a sufficiently ventilated crankcase is provided.

The formation of the oil return passages located at the ends of the respective rows of cylinders and the air introduction passages located at the middles of and by the sides of the respective rows of cylinders not only improves the oil returning effect, in particular, when the vehicle starts or turns, but also effectively prevents the air introduction passages from being closed with or clogged by oil even when the oil surges.

It should be noted that various changes and modifications may be apparent to those skilled in the art which are within the scope of the invention, and such changes and modifications are intended to be covered by the following claims.

What is claimed is:

1. A positive crankcase ventilation system for a V-type internal combustion engine having a cylinder block which is provided with elongated first and second cylinder banks set at an angle to each other and a crankcase formed in a bottom thereof, said first and second cylinder banks being, respectively, provided with first and second rows of cylinders offset in a lengthwise direction in which a crankshaft of the internal combustion engine extends relative to each other, said positive crankcase ventilation system comprising:

a series of reinforcing bulk heads, each said reinforcing bulk head being integral with a main bearing assembly holding a crankshaft of said internal combustion engine for reinforcing a structure of said cylinder block including said main bearing assembly;

at least one oil return passage formed in said cylinder block on one end of each said row of cylinders for returning oil into an oil pan attached to said bottom of said cylinder bank therethrough;

a blow-by gas discharge passage formed in said cylinder block on one end of each said row of cylinders for discharging blow-by gases out of said crankcase therethrough; and an air introduction passage formed in said cylinder block at the middle of and by one side of each said row of cylinders for introducing filtered air into said crankcase therethrough.

2. A positive crankcase ventilation system as defined in claim 1, wherein said oil return passage is formed in a dead corner of each said cylinder bank which is located at one end of one and the same said row of cylinders and by one side of the other said row of cylinders.

3. A positive crankcase ventilation system as defined in claim 2, wherein said air introduction passage is located outside each said row of cylinders.

4. A positive crankcase ventilation system as defined in claim 2, further comprising at least one blow-by gas discharge passage located inside each said row of cylinders.

5. A positive crankcase ventilation system as defined in claim 4, wherein said blow-by gas passage in said dead corner is larger in diameter than said at least one blow-by gas passage inside said row of cylinders.

6. A positive crankcase ventilation system as defined in claim 5, further comprising a blow-by gas outlet chamber formed in said cylinder block between said first and second cylinder banks, all of said blow-by gas passages being communicated with said blow-by gas outlet chamber.

7. A positive crankcase ventilation system as defined in claim 2, further comprising at least one oil return passage located outside of each said row of cylinders.

8. A positive crankcase ventilation system as defined in claim 1, wherein said reinforcing bulk heads divide said crankcase into a series of crankcase chambers.

9. A positive crankcase ventilation system as defined in claim 8, wherein each said crankcase chamber is formed with an opening in a bottom wall thereof opening into said oil pan.

10. A positive crankcase ventilation system as defined in claim 9, wherein each said bulk head is formed with at least one vent hole for communicating said crankcase chambers divided thereby with each other.

11. A positive crankcase ventilation system for a V-6 type internal combustion engine having a cylinder block which is provided with elongated first and second cylinder banks set at an angle to each other and a crankcase formed in a bottom thereof, said first and second cylinder banks being provided with first and second rows of three cylinders offset in a lengthwise direction in which a crankshaft of the internal combustion engine extends relative to each other, said positive crankcase ventilation system comprising:

a series of reinforcing bulk heads for forming three crankcase chambers having bottom openings opening into said oil pan attached to said bottom of said cylinder block, each said reinforcing bulk head being integral with a main bearing assembly holding a crankshaft of said internal combustion engine for reinforcing a structure of said cylinder block including said main bearing assembly;

at least one oil return passage formed in a dead part of each said cylinder bank, which is formed at one end of one and the same said row of three cylinders and on one side of the other said row of three cylinders, in said cylinder block for returning oil into said oil pan;

a blow-by gas discharge passage formed in said dead part of each said cylinder bank for discharging blow-by gas out of said crankcase therethrough;

at least one blow-by gas discharge passage formed inside each said row of cylinders in said cylinder block, said at least one blow-by gas passage being smaller in diameter than said blow-by gas passage in said dead part; and an air introduction passage formed at the middle of and one outside of each said row of three cylinders in said cylinder block for introducing filtered air into said crankcase chambers therethrough.

12. A positive crankcase ventilation system as defined in claim 11, wherein each said bulk head is formed with at least one vent hole for communicating said crankcase chambers divided thereby with each other.

13. A positive crankcase ventilation system as defined in claim 11, wherein said air introduction passage is located towards a center crankcase chamber and said oil passage is located so as to open in an extreme crankcase chamber.

* * * * *